US006234137B1

(12) United States Patent
Spriegel et al.

(10) Patent No.: US 6,234,137 B1
(45) Date of Patent: May 22, 2001

(54) ENGINE LUBRICATING APPARATUS AND METHOD OF OPERATING AN ENGINE HAVING SUCH AN APPARATUS

(75) Inventors: Andrew R. Spriegel, Erie, PA (US); Michael A. Fitzpatrick, Lyndhurst, OH (US)

(73) Assignee: General Electric Company, Schenectady, NY (US)

( * ) Notice: Subject to any disclaimer, the term of this patent is extended or adjusted under 35 U.S.C. 154(b) by 0 days.

(21) Appl. No.: 09/426,477

(22) Filed: Oct. 26, 1999

(51) Int. Cl.[7] ..... F01M 11/03
(52) U.S. Cl. ..... 123/196 A; 184/6.24
(58) Field of Search ..... 123/196 A; 184/6.24

(56) References Cited

U.S. PATENT DOCUMENTS 1,587,800 * 6/1926 Saives ..... 184/6.24
1,671,391 * 5/1928 Winslow et al. ..... 184/6.24
6,024,193 * 2/2000 Fukushima ..... 184/6.28

* cited by examiner

*Primary Examiner*—Willis R. Wolfe
*Assistant Examiner*—Katrina B. Harris
(74) *Attorney, Agent, or Firm*—Carl A. Rowold, Esq.; Holland & Knight LLP; David G. Maire, Esq.

(57) ABSTRACT

A lubricating apparatus for an internal combustion engine incorporating a trap in fluid communication with a low point of the sump of the engine. The trap may house a plurality of meshes having a plurality of sizes for trapping precipitating solids. The trap may be isolated from the sump by a valve for cleaning of the trap and meshes. An auxiliary oil pump may provide a small flow of oil through the trap during periods of engine shutdown.

36 Claims, 1 Drawing Sheet

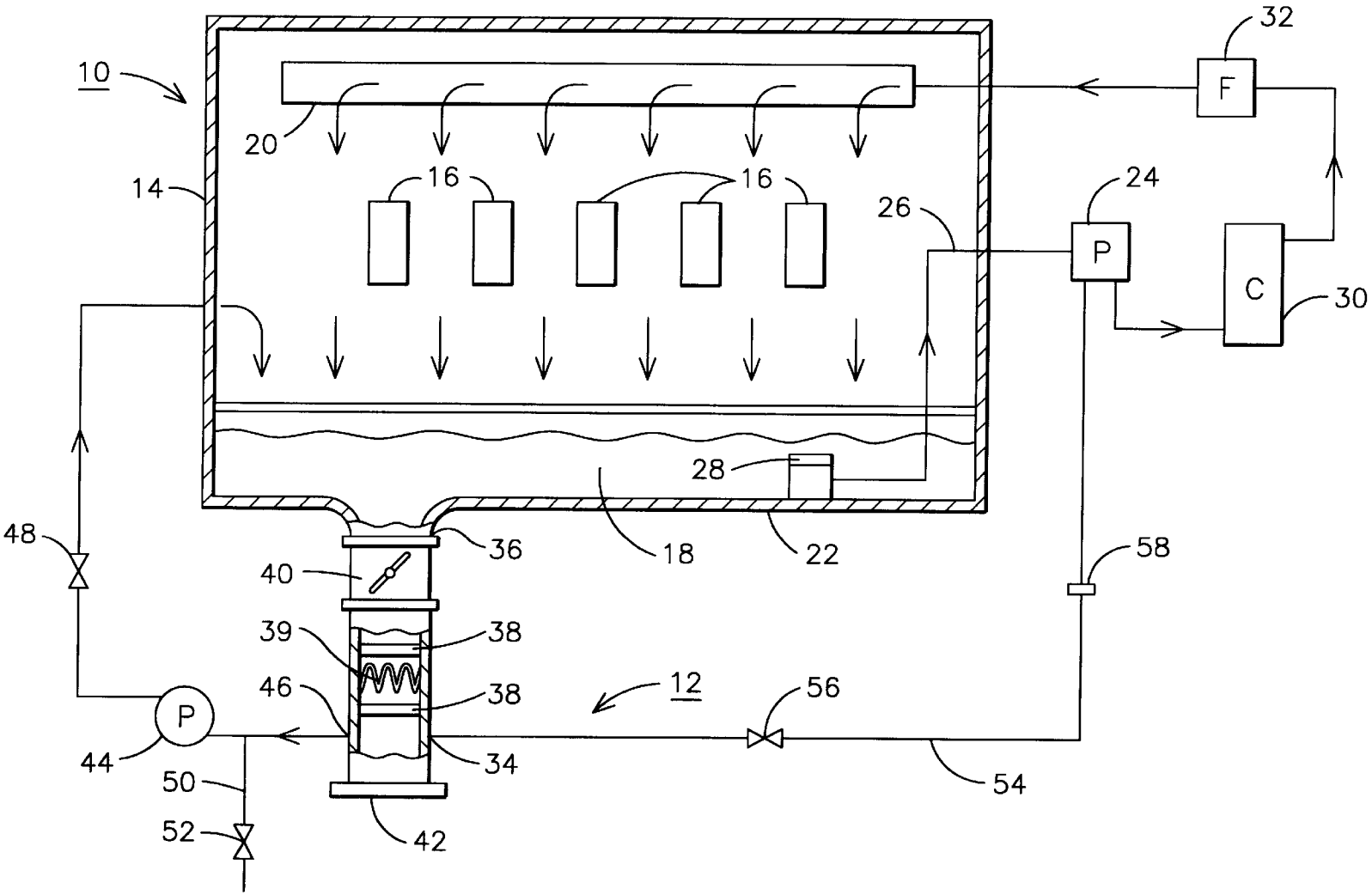
F
C
P
P
10
12
14
16
16
18
20
22
24
26
28
30
32
34
36
38
38
39
40
42
44
46
48
50
52
54
56
58

ENGINE LUBRICATING APPARATUS AND METHOD OF OPERATING AN ENGINE HAVING SUCH AN APPARATUS

BACKGROUND OF THE INVENTION

The present invention relates generally to the field of lubricating systems for internal combustion engines, and, more particularly, to an apparatus and method of lubricating the engine of a locomotive.

The filtration and conditioning of the lubricating oil of an internal combustion engine are critical for maintaining the reliability of the engine. It is known that particulate matter will become entrained in the lubricating oil during the operation of an internal combustion engine. The particulate matter may be introduced as a byproduct of the combustion process or by the wearing of metallic parts within the engine. It is also possible that solid debris may enter an engine during a maintenance operation. It is known to provide a filter in the lubricating oil flow path of an internal combustion engine in order to remove particulate matter. As the oil is pumped through the oil filter, particles entrained within the oil will become trapped on the filter media. Oil passing through the filter is then returned to the engine essentially free of particulate matter exceeding a certain size. It is known that such filters have a finite life depending upon the quantity of particulates within the oil and the relationship of the size of the particulates to the size of the passages through the filter. Once a filter becomes sufficiently clogged with particulate matter, the flow of oil through the filter will become impeded. If the pressure of the oil is sufficiently high, a clogged filter may fail mechanically thereby allowing unfiltered oil to bypass the filter media.

In the field of locomotive engines as well as in most commercial applications, it is desirable to extend the interval between oil and oil filter changes in order to maximize the on-train availability of the locomotive. The frequency of lubrication system maintenance usually depends upon one of two factors: the depletion of certain beneficial additives within the oil and the maximum useful life of the oil filter. It is known that certain additives such as surfactants, detergents and buffers within lubricating oil become depleted as an engine is operated. It is possible to add additional quantities of such additives to extend the interval between oil changes. However, the useful life of the oil filter may then become the limiting factor defining the interval between lubrication system maintenance services.

BRIEF SUMMARY OF THE INVENTION

Thus, there is a particular need for an apparatus and method for extending the interval between oil filter changes in an internal combustion engine. A lubricating apparatus for an engine is described herein that provides such an extended service interval, the lubricating apparatus comprising a sump for containing oil, the sump disposed proximate a bottom portion of an engine and operable to collect oil flowing out of the engine; a pump having an inlet in fluid communication with the sump and operable to pump the oil through the lubricating apparatus and the engine; a filter in fluid communication with the pump and having an outlet in fluid communication with the engine for providing filtered oil to the engine; and a trap for collecting solids precipitating out of the oil in the sump, the trap being in fluid communication with a low point in the sump. The trap may be formed as a housing disposed below the sump and may contain a plurality of meshes having a variety of opening sizes. In operation, the trap functions to contain particulate matter settling out of the lubricating oil and to prevent such solid matter from reentering the flow path of the oil. A fluid communication path may be provided from the bottom of the housing back to the sump, with an auxiliary oil pump maintaining a small flow of oil down through the meshes to ensure that the particulate matter remains entrained in the trap. The auxiliary oil pump may remain in operation during periods of engine shutdown to promote the settling of particulate matter into the trap.

BRIEF DESCRIPTION OF THE DRAWING

The features and advantages of the present invention will become apparent from the following detailed description of the invention when read with the accompanying drawing which is a schematic illustration of a lubricating apparatus for an engine containing a trap for collecting solids.

DETAILED DESCRIPTION OF THE INVENTION

An engine 10 having a lubricating apparatus 12 is schematically illustrated in the FIGURE. The engine 10 may be any internal combustion engine, and in one embodiment is the engine of a locomotive. The engine includes a block 14 containing a plurality of moving parts 16 as is known in the art. A lubricant such as oil 18 is utilized to minimize the friction on the moving parts 16 within the engine 10 and to remove heat from selected parts such as bearings. The oil 18 may be distributed throughout the engine 10 in a variety of channels, such as the engine oil header 20 as may be provided in a diesel locomotive engine. A sump 22 for containing the oil 18 is located at a bottom portion of the engine 10 and is operable to collect oil flowing out of the block 14. The sump 22 may be, for example, an oil pan attached to the bottom of an engine block 14. An oil pump 24 is utilized to pump the oil 18 throughout the engine 10. Pump 24 has an inlet line 26 that may draw oil through a strainer 28 located above the bottom of the sump 22. In order to avoid drawing solid objects into the inlet of the pump 24, it is known to locate the oil pump suction inlet above the bottom of the sump 22. In the embodiment illustrated in the FIGURE, a strainer 28 is provided over the inlet to oil line 26. The outlet of pump 24 is directed to a lube oil cooler 30, and then to a oil filter 32 before being directed back to the engine 10 through engine oil header 20.

The lubricating apparatus 12 further includes a trap 34 for collecting solids precipitating out of the oil 18 in the sump 22. The trap 34 is in fluid communication with a low point 36 in the sump 22, which in the embodiment shown in the FIGURE is at a point located remote from the oil pump suction inlet. In the embodiment illustrated in the FIGURE, the trap 34 is a housing 34 having a plurality of meshes 38 contained therein. The meshes 38 may be, for example, stainless steel screen material having a plurality of sizes, with the meshes 38 being vertically arranged within the trap housing 34 so that the mesh sizes decrease from the top to the bottom. In this manner, larger particles will become entrapped on an upper mesh, while smaller particles settle to lower level meshes. Advantageously, trap 34 is in fluid communication with a low point in sump 22 wherein there is a relatively low flow velocity. As particles precipitate from the oil into the trap housing 34, there is no upward flow of the oil 18 causing them to be reintroduced into the oil in the sump 22. In this manner, particles of a variety of sizes are taken out of the flow of the lubricating oil 18, thereby reducing the amount of particles that must be entrained by filter 32. As a result, filter 32 will have a longer usable life, thereby extending the interval between oil filter changes for engine 10. Trap 34 will also act as a passive recipient for particles during periods of shutdown of engine 10. When engine 10 is shut down and the oil drains into sump 22, the passive filtering action of trap 34 will continue as the particles entrained within the oil continue to settle out. Because there is no flow through trap 34 during the operation of engine 10, even very small particles having settled into trap 34 will remain within the trap and will not be drawn back into the primary oil flow.

One or more of the meshes 38 may have a corrugated shape, such as mesh 39. A corrugated mesh 39 will tend to collect particulate matter in the low points of the corrugations at a faster rate than at the high points of the corrugation. In the event that the mesh 39 becomes clogged at the low points of the corrugation, it will still be able to pass fluid and small particles through the unclogged high points of the corrugation, thereby increasing the interval before the mesh must be cleaned or replaced.

In the embodiment illustrated in the FIGURE, the trap housing 34 is connected to the sump 22 by valve 40. Valve 40 may be any style of valve known in the art, such as a butterfly or ball valve for example. Valve 40 allows trap 34 to be cleaned without changing the oil 18 within the engine 10. Traps 34 may even be cleaned during the operation of engine 10 if desired, assuming that proper safety measures are designed into such an embodiment to eliminate the risk of injury to the personnel performing such maintenance. In one embodiment, trap 34 is formed having a cover 42 that may be removed to provide access to meshes 38. After engine 10 has been operated for a first period of time, the fluid communication between the trap 34 and the sump 22 may be isolated by closing valve 40. Cover 42 may then be opened, and meshes 38 removed for cleaning and/or replacement. For the embodiment of a stainless steel screen mesh 38, a majority of the entrapped particles may be removed by simply flushing the mesh 38 with a solvent such as kerosene. Once the cleaned or renewed meshes 38 are installed into the housing 34, the cover 42 may be reinstalled and the fluid communication between the trap 34 and the sump 22 reestablished by opening valve 40. The engine 10 may then be operated for an additional period of time prior to the replacement of oil 18 and filter 32.

In one embodiment, as illustrated in the FIGURE, an auxiliary oil pump 44 may be connected between an outlet 46 of the trap 34 and the sump 22 through an isolation valve 48. A drain line 50 having an isolation valve 52 may also be provided. The auxiliary oil pump 44 may be used to establish a small flow of oil into the top of the trap 34, thereby assuring that particles entering the trap and being entrained on the meshes 38 will not be washed back into sump 22. Auxiliary oil pump 44 may remain active even after the engine 10 is shut down and the main oil pump 24 is deactivated. By providing a small recirculating flow from the sump 22 through meshes 38, the precipitation of solid particles into the trap 34 may be maximized during the engine shutdown period. There may further be a recirculation line 54 connected between trap 34 and oil pump 24 through valve 56 to provide a small flow through trap 34 during the operation of oil pump 24. Valve 56 may provide fluid isolation and/or throttling of the rate of flow. Alternatively, the size of line 54 may be selected to achieve the desired low flow rate, and/or a flow restricting orifice 58 may be used.

Meshes 38 provide a convenient mechanism for the sampling of particles of a variety of sizes from an operating engine. By isolating trap 34 from the sump 22 by closing valves 40, 48, it is possible to remove a sample of particles from the trap 34 for analysis purposes. With proper system design, such sampling may be done without interfering with the normal operation of the engine 10.

By providing a debris trap at a low point within engine 10, the particles drawn into trap 34 are likely to be of a different distribution of sizes than the particles drawn into oil pump 24 through oil line 26. For example, relatively larger particles will remain at the bottom of sump 22 and will not be drawn up into strainer 28. Furthermore, relatively smaller particles that pass through filter 32 may be collected in the stagnant volume of the sump 34 assuming there is no flow through auxiliary pump 44. Alternatively, if auxiliary oil pump 44 is used, a much smaller mesh size may be used in the sump 34 than is used in the filter 32. The filtration size of filter 32 is selected to accommodate a large flow volume, and to ensure that the filter will not become clogged with very small particles in a short time period, since the consequences of the blockage of filter 32 are severe. However, engine 10 may continue to operate safely without trap 34, os the minimum size of the meshes 38 may be selected to be significantly smaller than the minimum mesh size of filter 32. Therefore, sump 34 reduces the total quantity of particles that must be captured by filter 32, it may be entrain both larger and smaller particles than filter 32, and it provides a filtering action during periods of operation of engine 10 and during periods of engine shutdown.

Although trap 34 is illustrated as being a separate housing located below the sump 22, additional embodiments may be envisioned having such a trap 34 formed within a sump 22. A bulge or other low point formed in a sump or crankcase pan may preferably contain an opening for the insertion and removal of one or more meshes. In lieu of meshes, any structure forming a downwardly sloping tortuous path for particles precipitating out of the oil may be used. Such structure does not inhibit the precipitation of the particles into the trap, however it does inhibit the circulation of oil flowing above the trap from creating currents of flow into the trap, thereby tending to lift particles out of the trap. Preferably the flow of oil during the operation of the engine is across the inlet to the trap in a horizontal direction. Vertically precipitating particles are then removed from the horizontal flow path once they enter the trap. The walls of the trap limit the intrusion of the oil flow into the depths of the trap. Thus particles precipitating into the trap will not be drawn back into the main oil flow during subsequent periods of operation.

While the preferred embodiments of the present invention have been shown and described herein, it will be obvious that such embodiments are provided by way of example only. Numerous variations, changes and substitutions will occur to those of skill in the art without departing from the invention herein. Accordingly, it is intended that the invention be limited only by the spirit and the scope of the appended claims.

We claim as our invention:

1. A lubricating apparatus for an engine, the lubricating apparatus comprising:

a sump for containing oil, the sump disposed proximate a bottom portion of an engine and operable to collect oil flowing out of the engine;

a pump having an inlet in fluid communication with the sump and operable to pump the oil through the lubricating apparatus and the engine;

a filter in fluid communication with the pump and having an outlet in fluid communication with the engine for providing filtered oil to the engine;

a trap for collecting solids precipitating out of the oil in the sump, the trap being in fluid communication with a low point in the sump;

wherein the trap is located at a point remote from the pump inlet.

2. The apparatus of claim 1, the trap further comprising a plurality of meshes having a plurality of sizes, the meshes being vertically arranged within the trap so that the mesh sizes decrease from top to bottom.

3. The apparatus of claim 2, wherein at least one of the meshes has a corrugated shape.

4. The apparatus of claim 1, wherein the trap further comprises a housing disposed below the sump.

5. The apparatus of claim 4, wherein the pump comprises a main oil pump and wherein the fluid communication between a low point in the sump and the housing comprises an inlet to the housing, and further comprising:

an outlet from the housing in fluid communication with the sump; and an auxiliary oil pump connected between the outlet from the housing and the sump.

6. The apparatus of claim 4, further comprising a plurality of meshes having a plurality of sizes disposed within the housing, the meshes being vertically arranged within the housing so that the mesh sizes decrease from top to bottom.

7. The apparatus of claim 6, wherein the housing comprises a first portion removeably attached to a second portion, and wherein the meshes are removable from the housing when the first portion is removed from the second portion.

8. The apparatus of claim 7, further comprising a valve connected between the housing and the sump.

9. The apparatus of claim 4, wherein the fluid communication between a low point in the sump and the housing comprises an inlet to the housing, and further comprising an outlet from the housing in fluid communication with the sump.

10. The apparatus of claim 9, further comprising a valve connected to the inlet to the housing.

11. The apparatus of claim 9, further comprising a valve connected between the housing outlet and the sump.

12. The apparatus of claim 1, further comprising a drain line attached to the trap.

13. The apparatus of claim 1, wherein the pump comprises a main oil pump and wherein the fluid communication between the trap and a low point in the sump comprises an inlet to a housing, and further comprising an outlet from the housing in fluid communication with the main oil pump inlet.

14. An engine for a locomotive, the engine comprising:

a block containing moving parts;

a sump for collecting lubricating oil draining from the block;

an oil pump for circulating lubricating oil from the sump to the block for lubricating the moving parts, the oil pump having a suction inlet disposed within the sump;

a filter disposed in a flow path of the oil;

a trap for collecting solids precipitating out of the oil in the sump, the trap being in fluid communication with a low point in the sump;

wherein the trap is disposed at a point remote from the oil pump suction inlet.

15. The engine of claim 14, wherein the trap comprises a housing disposed below the sump.

16. The engine of claim 15, further comprising a plurality of meshes having a plurality of sizes disposed within the housing.

17. The engine of claim 15, further comprising a valve connected between the sump and the housing.

18. The engine of claim 15, wherein the fluid communication between a low point in the sump and the housing comprises an inlet to the housing, and further comprising an outlet from the housing in fluid communication with the inlet of the pump.

19. The engine of claim 16, wherein the housing comprises a removable portion providing access to the meshes.

20. A method of operating a locomotive engine, the engine comprising a sump disposed proximate the engine for collecting oil flowing out of the engine, a pump having an inlet disposed in the sump for circulating oil from the sump through the engine, and a filter in a flow path of the oil, the method comprising the steps of:

providing a trap at a low point of the sump remote from the pump inlet, the trap in fluid communication with the sump to collect solid particles precipitating out of the oil and operable to prevent the particles from re-entering the flow of the oil;

operating the engine for a first period of time;

isolating the fluid communication between the trap and the sump;

cleaning the trap to remove a majority of the particles;

re-establishing the fluid communication between the trap and the sump;

operating the engine a second period of time.

21. The method of claim 20, further comprising the step of removing a sample of the particles from the trap and analyzing the sample of the particles.

22. The method of claim 20, wherein the step of providing a trap further comprises providing a housing having an inlet in fluid communication with the low point of the sump, and further comprising the steps of:

providing an auxiliary oil pump having an inlet connected to an outlet of the housing and having an outlet in fluid communication with the sump; and operating the auxiliary oil pump to maintain a flow through the housing during periods of engine shutdown.

23. A lubricating apparatus for an engine, the lubricating apparatus comprising:

a sump for containing oil, the sump disposed proximate a bottom portion of an engine and operable to collect oil flowing out of the engine;

a pump having an inlet in fluid communication with the sump and operable to pump the oil through the lubricating apparatus and the engine;

a filter in fluid communication with the pump and having an outlet in fluid communication with the engine for providing filtered oil to the engine;

a trap for collecting solids precipitating out of the oil in the sump, the trap being in fluid communication with a low point in the sump;

the trap further comprising a plurality of meshes having a plurality of sizes, the meshes being vertically arranged within the trap so that the mesh sizes decrease from top to bottom.

24. The apparatus of claim 23, wherein the trap further comprises a housing disposed below the sump.

25. The apparatus of claim 24, further comprising a plurality of meshes having a plurality of sizes disposed within the housing, the meshes being vertically arranged within the housing so that the mesh sizes decrease from top to bottom.

26. The apparatus of claim 25, wherein the housing comprises a first portion removeably attached to a second portion, and wherein the meshes are removable from the housing when the first portion is removed from the second portion;

further comprising a valve connected between the housing and the sump.

27. The apparatus of claim 24, wherein the fluid communication between a low point in the sump and the housing comprises an inlet to the housing, and further comprising an outlet from the housing in fluid communication with the sump;

further comprising a valve connected to the inlet to the housing.

28. The apparatus of claim 24, wherein the fluid communication between a low point in the sump and the housing comprises an inlet to the housing, and further comprising an outlet from the housing in fluid communication with the sump;

further comprising a valve connected between the housing outlet and the sump.

29. The apparatus of claim 24, wherein the pump comprises a main oil pump and wherein the fluid communication between a low point in the sump and the housing comprises an inlet to the housing, and further comprising:

an outlet from the housing in fluid communication with the sump; and an auxiliary oil pump connected between the outlet from the housing and the sump.

30. The apparatus of claim 23, wherein at least one of the meshes has a corrugated shape.

31. An engine for a locomotive, the engine comprising:

a block containing moving parts;

a sump for collecting lubricating oil draining from the block;

an oil pump for circulating lubricating oil from the sump to the block for lubricating the moving parts;

a filter disposed in a flow path of the oil;

a trap for collecting solids precipitating out of the oil in the sump, the trap being in fluid communication with a low point in the sump;

wherein the trap comprises a housing disposed below the sump;

further comprising a plurality of meshes having a plurality of sizes disposed within the housing.

32. The engine of claim 31, wherein the housing comprises a removable portion providing access to the meshes.

33. An engine for a locomotive, the engine comprising:

a block containing moving parts;

a sump for collecting lubricating oil draining from the block;

an oil pump for circulating lubricating oil from the sump to the block for lubricating the moving parts;

a filter disposed in a flow path of the oil;

a trap for collecting solids precipitating out of the oil in the sump, the trap being in fluid communication with a low point in the sump;

wherein the trap comprises a housing disposed below the sump;

further comprising a valve connected between the sump and the housing.

34. An engine for a locomotive, the engine comprising:

a block containing moving parts;

a sump for collecting lubricating oil draining from the block;

an oil pump for circulating lubricating oil from the sump to the block for lubricating the moving parts;

a filter disposed in a flow path of the oil;

a trap for collecting solids precipitating out of the oil in the sump, the trap being in fluid communication with a low point in the sump;

wherein the trap comprises a housing disposed below the sump;

wherein the fluid communication between a low point in the sump and the housing comprises an inlet to the housing, and further comprising an outlet from the housing in fluid communication with the inlet of the pump.

35. A method of operating a locomotive engine, the engine comprising a sump disposed proximate the engine for collecting oil flowing out of the engine, a pump for circulating oil from the sump through the engine, and a filter in a flow path of the oil, the method comprising the steps of:

providing a trap at a low point of the sump, the trap operable to collect solid particles precipitating out of the oil and operable to prevent the particles from re-entering the flow of the oil;

operating the engine for a first period of time;

isolating the fluid communication between the trap and the sump;

cleaning the trap to remove a majority of the particles;

re-establishing the fluid communication between the trap and the sump;

operating the engine a second period of time;

wherein the step of providing a trap further comprises providing a housing having an inlet in fluid communication with the low point of the sump, and further comprising the steps of:

providing an auxiliary oil pump having an inlet connected to an outlet of the housing and having an outlet in fluid communication with the sump; and operating the auxiliary oil pump to maintain a flow through the housing during periods of engine shutdown.

36. A method of operating a locomotive engine, the engine comprising a sump disposed proximate the engine for collecting oil flowing out of the engine, a main oil pump for circulating oil from the sump through the engine while the engine is operating, and a filter in a flow path of the oil, the method comprising the steps of:

providing a trap at a low point of the sump, the trap containing a mesh to collect solid particles out of the oil and operable to prevent the particles from re-entering the sump;

providing a flow of oil through the mesh to collect solid particles out of the oil during a period of engine shutdown when the main oil pump is deactivated.

* * * * *